US011840042B1

(12) United States Patent
Liang et al.

(10) Patent No.: US 11,840,042 B1
(45) Date of Patent: Dec. 12, 2023

(54) AUTOMATIC CARTON FORMING DEVICE

(71) Applicant: BEIJING INSTITUTE OF GRAPHIC COMMUNICATION, Beijing (CN)

(72) Inventors: Lijuan Liang, Beijing (CN); Yang Guo, Beijing (CN); Songhua He, Beijing (CN); Zhaohui Yu, Beijing (CN); Lianfang Li, Beijing (CN); Shengzhen Liu, Beijing (CN); Hongfeng Zuo, Beijing (CN); Lanlan Hou, Beijing (CN)

(73) Assignee: BEIJING INSTITUTE OF GRAPHIC COMMUNICATION, Beijing (CN)

( * ) Notice: Subject to any disclaimer, the term of this patent is extended or adjusted under 35 U.S.C. 154(b) by 0 days.

(21) Appl. No.: 18/109,836

(22) Filed: Feb. 14, 2023

(51) Int. Cl.

| | |
|---|---|
| ***B31B 50/78*** | (2017.01) |
| ***B31B 50/06*** | (2017.01) |
| ***B31B 50/07*** | (2017.01) |
| ***B31B 50/00*** | (2017.01) |
| *B31B 110/35* | (2017.01) |
| *B31B 100/00* | (2017.01) |

(52) U.S. Cl.
CPC ..... *B31B 50/78* (2017.08); *B31B 50/005* (2017.08); *B31B 50/06* (2017.08); *B31B 50/07* (2017.08); *B31B 50/006* (2017.08); *B31B 2100/002* (2017.08); *B31B 2110/35* (2017.08)

(58) Field of Classification Search
None
See application file for complete search history.

(56) References Cited

U.S. PATENT DOCUMENTS 2,612,823 A * 10/1952 Woelfer ..... B31B 50/00 493/317
2,782,695 A * 2/1957 Meissner ..... B65B 43/285 493/183
3,016,808 A * 1/1962 Galloway ..... B65B 43/185 53/566
3,040,634 A * 6/1962 Galloway ..... B31B 50/00 493/319
4,160,406 A * 7/1979 Nowacki ..... B31B 50/064 493/128
5,393,291 A * 2/1995 Wingerter ..... B31B 50/80 493/317

FOREIGN PATENT DOCUMENTS

WO WO-9908864 A1 * 2/1999 ..... B31B 50/00

* cited by examiner

*Primary Examiner* — Tanzim Imam

(57) ABSTRACT

An automatic carton forming device includes a supporting table, a storage rack, a limiting part, a transporting part, and a folding part. The storage rack is configured to store folded paper boards, the limiting part is configured to limit the folded paper boards, the transporting part includes a moving base and a driving unit for driving the moving base to move. At least one first vacuum suction cup is disposed on the moving base, the limiting part includes an adsorbing base disposed on one end of the supporting table, at least one second vacuum suction cup is disposed on the adsorbing base. The folding part includes a first overturning plate, a vertical folding unit, a transverse folding unit, and a transmitting unit, and the transmitting unit drives the first overturning plate, the vertical folding unit, and the transverse folding unit to perform folding action.

10 Claims, 8 Drawing Sheets

AUTOMATIC CARTON FORMING DEVICE

TECHNICAL FIELD

The present disclosure relates to a field of carton processing devices, and in particular to an automatic carton forming device.

BACKGROUND

Processing procedures of cartons mainly include a printing procedure, a pressing procedure, a die cutting procedure, a gluing procedure, folding, bonding, and forming procedures, etc. Since formed cartons occupy a relatively large space, cartons stored in warehouses of manufacturers are folded cartons preliminarily formed after printing, pressing, die cutting, and nailing at ends, such folded cartons formed in flat occupy a relatively small space and are convenient for a large amount of storage. When using the cartons, the folded cartons which are preliminarily formed are unfolded and formed to be completely formed cartons having storage space for storing goods. Currently, enterprises mainly complete forming of the cartons by manual operation, such manual operation method has high requirements in labor intensity of workers, and is high in labor cost and low in carton forming efficiency.

SUMMARY

For defects in the prior art, the present disclosure aims to provide an automatic carton forming device to replace that folding and forming cartons by manual operation for solving problems that folding and forming cartons by the manual operation has high requirements in labor intensity of workers, and is high in labor cost for enterprises and low in carton forming efficiency.

In order to solve above technical problems, the present disclosure provides an automatic carton forming device, including a supporting table, a storage rack, a limiting part, a transporting part, and a folding part. The storage rack is configured to store folded paper boards, the limiting part is configured to limit the folded paper boards, the transporting part is configured to transport the folded paper boards in the storage rack to the limiting part, and the folding part is configured to unfold the folded paper boards on the limiting part. The storage rack is vertically disposed on the supporting table, the folded paper boards are vertically stacked in the storage rack for completely extending a bottommost one of the folded paper boards out of the storage rack to directly contact an upper surface of the supporting table. The transporting part includes a moving base and a driving unit, the driving unit drives the moving base to move in a length direction of the supporting table, at least one first vacuum suction cup is disposed on the moving base for adsorbing the folded paper boards. The limiting part includes an adsorbing base, the adsorbing base is disposed at one end of the supporting table, at least one second vacuum suction cup is disposed on the adsorbing base for adsorbing the folded paper boards and fixing the folded paper boards on the adsorbing base. The folding part includes a first overturning plate, a vertical folding unit, a transverse folding unit, and a transmitting unit. The first overturning plate is rotatably connected to the adsorbing base for overturning the folded paper boards to preliminarily unfold the folded paper boards to form square paperboard boxes, the vertical folding unit symmetrically folds an upper bottom plate and a lower bottom plate of each of the square paperboard boxes, the transverse folding unit symmetrically folds a left bottom plate and a right bottom plate of each of the square paperboard boxes, and the transmitting unit drives the first overturning plate, the vertical folding unit, and the transverse folding unit to perform folding action according to movement of the moving base.

When using the automatic carton forming device, a plurality of the folded paper boards are stacked in the storage rack, the driving unit is controller to drive the moving base to move to a position below the storage rack to adsorb the bottommost one of the folded paper boards, then the driving unit is controlled to drive the moving base to move to transport the bottommost one of the folded paper boards, so that one side wall of the bottommost one of the folded paper boards is located on the at least one second vacuum suction cup, the at least one second vacuum suction cup is operated to adsorb the one side wall of the bottommost one of the folded paper boards, then the vacuum suction cup is closed and the moving base is driven to turn back to the position below the storage rack. In a process of moving the moving base back to the position below the storage back, the transmitting unit drives the first overturning plate to overturn according to moving positions of the moving base, so that the bottommost one of the folded paper boards is preliminarily unfolded to form a square paperboard box, the transmitting unit further drives the vertical folding unit and the transverse folding unit to perform folding action to symmetrically fold side plates at a bottom of one end of the square paperboard box in sequence to form a carton, where a bottom of one end of the carton is closed.

Compared with the cartons formed by the manual operation, the present disclosure provides the automatic carton forming device which quickly transports the folded paper boards through the moving base and drives the folding part to quickly unfold the folded paper boards and re-fold the unfolded paper boards by the transmitting unit according to movement of the moving base to form cartons. The automatic carton forming device is high in forming speed and less in manual intervention, which reduces the labor intensity of workers, reduces the labor cost, and further improves the carton forming efficiency.

BRIEF DESCRIPTION OF DRAWINGS

The drawings described herein are used to provide a further understanding of the present disclosure to constitute a part of the present disclosure, and embodiments of the present disclosure and description thereof are used to explain the present disclosure, and do not constitute an improper limitation on the present disclosure. In the drawings.

DETAILED DESCRIPTION

Figure 1:
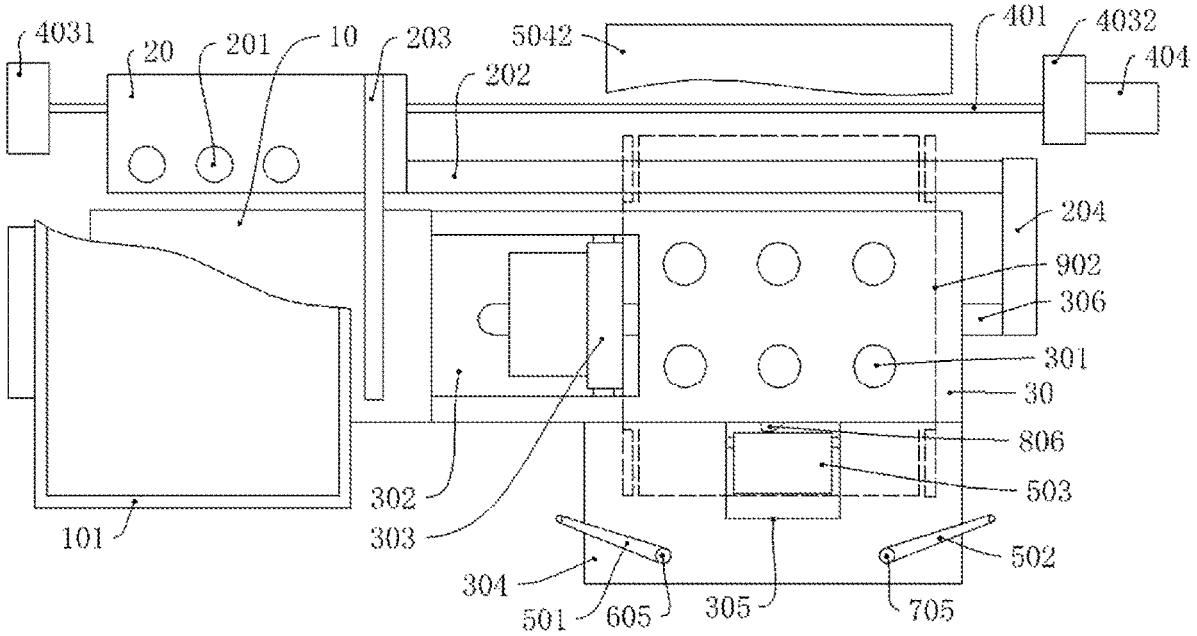
FIG. 1 is a structural schematic diagram of the present disclosure in a top view.
Figure 2:
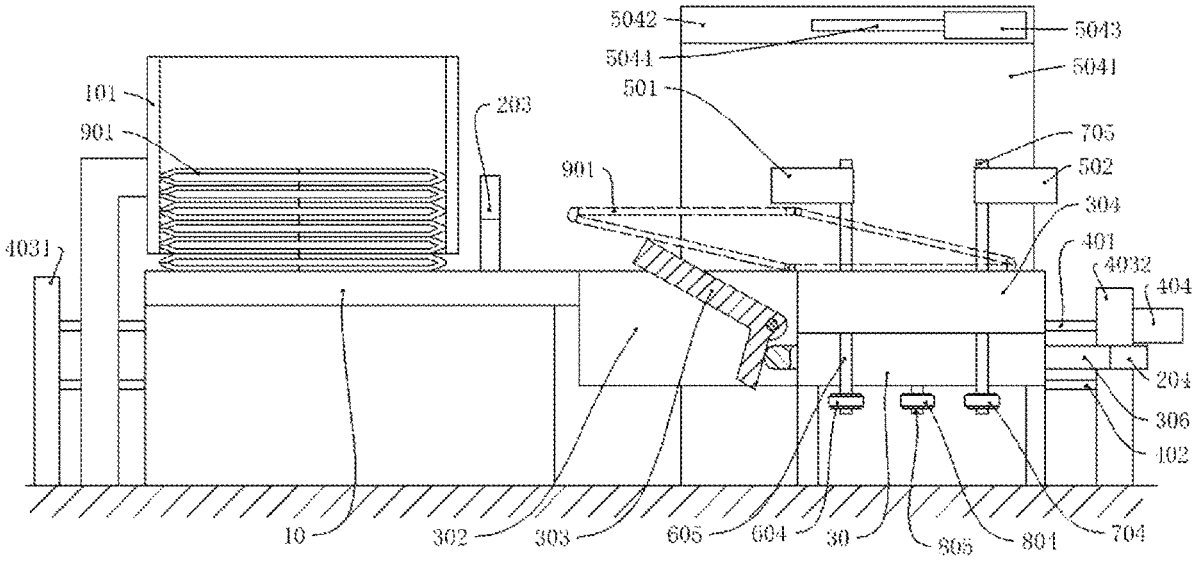
FIG. 2 is a structural schematic diagram of the present disclosure in a front view.
Figure 3:
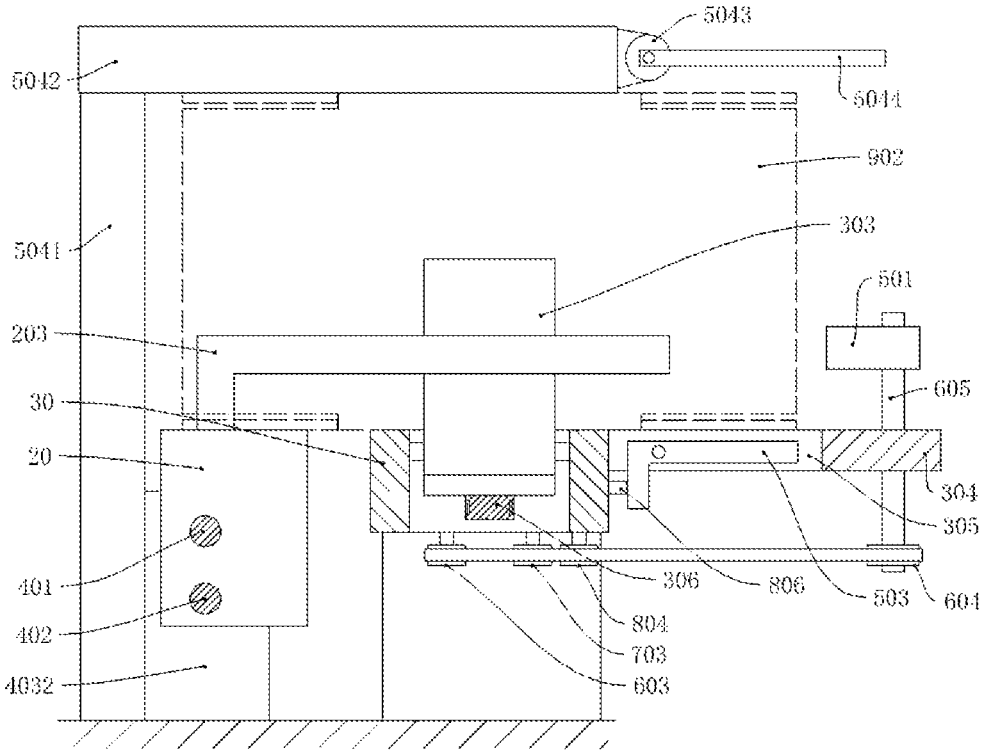
FIG. 3 is a structural schematic diagram of the present disclosure in a left view, where a part of components of the present disclosure are removed.

The present disclosure provides an automatic carton forming device, as shown in FIGS. 1-3, including a supporting table 10, a storage rack 101, a limiting part, a transporting part, and a folding part. The storage rack 101 is configured to store folded paper boards 901, the limiting part is configured to limit the folded paper boards 901, the transporting part is configured to transport the folded paper boards 901 in the storage rack 101 to the limiting part, and the folding part is configured to unfold the folded paper boards 901 on the limiting part. The storage rack 101 is vertically disposed on the supporting table 10, the folded paper boards 901 are vertically stacked in the storage rack 101 for completely extending a bottommost one of the folded paper boards 901 out of the storage rack 101 to directly contact an upper surface of the supporting table 10. The transporting part includes a moving base 20 and a driving unit, the driving unit drives the moving base 20 to move in a length direction of the supporting table 10, at least one first vacuum suction cup 201 is disposed on the moving base 20 for adsorbing the folded paper boards 901. The limiting part includes an adsorbing base 30, the adsorbing base 30 is disposed at one end of the supporting table 10, at least one second vacuum suction cup 301 is disposed on the adsorbing base 30 for adsorbing the folded paper boards 901 and fixing the folded paper boards 901 on the adsorbing base 30. The folding part includes a first overturning plate 303, a vertical folding unit, a transverse folding unit, and a transmitting unit. The first overturning plate 303 is rotatably connected to the adsorbing base 30 for overturning the folded paper boards 901 to preliminarily unfold the folded paper boards to form square paperboard boxes 902, the vertical folding unit symmetrically folds an upper bottom plate and a lower bottom plate of each of the square paperboard boxes 902, the transverse folding unit symmetrically folds a left bottom plate and a right bottom plate of each of the square paperboard boxes 902, and the transmitting unit drives the first overturning plate 303, the vertical folding unit, and the transverse folding unit to perform folding action according to movement of the moving base 20.

Figure 4:
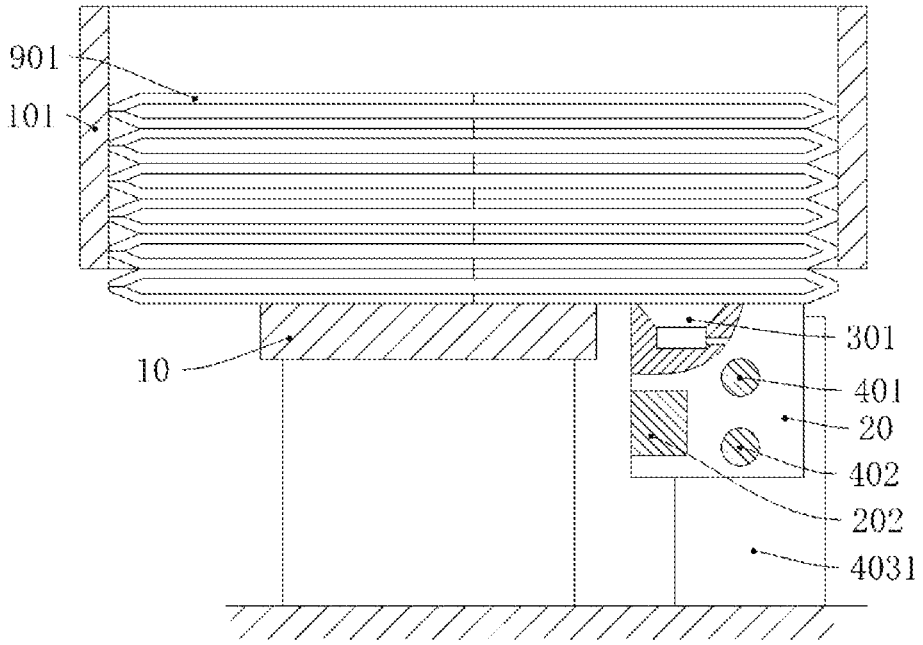
FIG. 4 is a schematic diagram of a cooperation of a moving base and a storage rack.

Please further refer to FIG. 4, the storage rack 101 is a frame body having openings at upper and lower ends, where the frame body is vertically disposed. The storage rack 101 is fixedly connected to ground by a first support, and the storage rack 101 is disposed above a position close to a first end of the supporting table 10, and the supporting table 10 is a horizontally placed cuboid. The first support is disposed at a bottom of the supporting table 10 for fixedly connecting or detachably connecting the supporting table 10 to the ground. A distance between two ends of an opening of each of the folded paper boards 901 is a width of each of the folded paper boards 901, the folded paper boards 901 are horizontally placed, a width direction of each of the folded paper boards 901 us perpendicular to a length direction of the supporting table 10, and a width of the supporting table 10 is less than the width of each of the folded paper boards 901. When the folded paper boards 901 are placed in the storage rack 101, the bottommost one of the folded paper boards 901 completely extends out of the storage rack 101 to directly contact the upper surface of the supporting table 10, a part of a board body of each of the folded paper boards 901 is positioned out of one side, close to the moving base 20, of the supporting table 10, which is convenient for the at least one first vacuum suction cup 201 on the moving base 20 to adsorb and transport the folded paper boards 901.

The adsorbing base 30 is disposed at a position close to a second end of the supporting table 10, and the adsorbing base 30 is a horizontally placed cuboid, a second support is disposed at a bottom of the adsorbing base 30 for fixedly connecting or detachably connecting the adsorbing base 30 to the ground, an upper surface of the adsorbing base 30 is flush with the upper surface of the supporting table 10, and the at least one second vacuum suction cup 301 is embedded in the upper surface of the adsorbing base 30. In one embodiment, six second vacuum suction cups 301 are disposed on the adsorbing base 30. In other embodiments, the at least one second vacuum suction cup 301 may be set in other quantities as required. When the at least one second vacuum suction cup 301 adsorbs the folded paper boards 901, the bottommost one of the folded paper boards 901 is attached to the upper surface of the adsorbing base 30, a sensor and a microcomputer are disposed on the adsorbing base 30 for electrically connecting to an external vacuumizing device to control an operation state of the at least one second vacuum suction cup 301. A first slot 302 is vertically disposed on one end, close to the supporting table 10, of the adsorbing base 30 for overturning of the first overturning plate 303, the first slot 302 vertically penetrates through the adsorbing base 30, the first overturning plate 303 is an L-shaped overturning plate, the first overturning plate 303 is disposed in the first slot 302, rotation shafts are horizontally disposed at horizontal ends of the first overturning plate 303 for rotatably connecting the first overturning plate 303 and the adsorbing base 30, and a rotation axis of the first overturning plate 303 is horizontally disposed and is perpendicular to the length direction of the supporting table 10. A torsion spring is disposed on the first overturning plate 303, when the first overturning plate 303 is driven by external torque to overturn, the torsion spring disposed on the first overturning plate 303 forces the first overturning plate 303 to reset to an original position.

The driving unit includes a lead screw 401, a guiding rod 402, supporting plates 4031, and a driving motor 404. The lead screw 401 is disposed in up-down parallel with the guiding rod 402, the lead screw 401 and the guiding rod 402 are disposed at the same side of the supporting table 10 and are parallel to the length direction of the supporting table 10. The supporting plates include a first supporting plate 4031 and a second supporting plate 4032, the first supporting plate 4031 is disposed at a first end of the lead screw 401 and a first end of the guiding rod 402, and the second supporting plate 4032 is disposed at a second end of the lead screw 401 and the second end of the guiding rod 402. The first supporting plate 4031 and the second supporting plate 4032 are both vertically disposed and fixedly connected to the ground, the first end of the lead screw 401 is fixedly connected the first supporting plate 4031, the first end of the guiding rod 402 is fixedly connected to the first supporting plate 4031, the second end of the lead screw 401 is rotatably connected to the second supporting plate 4032, and the second end of the guiding rod 402 is fixedly connected to the second supporting plate 4032.

The moving base 20 is cuboid, a length direction of the moving base 20 is parallel to the length direction of the supporting table 10, an upper surface of the moving base 20 is flush with the upper surface of the supporting table 10, a threaded through hole matched with the lead screw 401 and a guiding hole slidably matched with the guiding rod 402 are defined on the moving base 20 along the length direction of the moving base 20, the threaded through hole and the guiding hole penetrate through the moving base 20. A first push plate 203 is fixedly connected to one end, close to the adsorbing base 30, of the moving base 20. A first end of the first push plate 203 is fixedly connected to the moving base 20, a second end of the first push plate 203 extends along a direction perpendicular to the length direction of the supporting table 10 and is located above the supporting table 10. In the embodiment, three first vacuum suction cups 201 are disposed on the moving base 20, the three first vacuum suction cups 201 are arranged along the length direction of the moving base 20, the three first vacuum suction cups 201 are embedded in the upper surface of the moving base 20, the three first vacuum suction cups 201 are externally connected with a vacuumizing device, when the three first vacuum suction cups 201 adsorb the folded paper boards 901, the bottommost one of the folded paper boards 901 is attached to the upper surface of the moving base 20. A sensor and a microcomputer are disposed on the moving base 20 for electrically connecting to an external vacuumizing device to control an operation state of the at least one first vacuum suction cup 201. The driving motor 404 is a stepping motor, the driving motor 404 is externally connected with a power cord, the driving motor 404 is fixedly connected to the second supporting plate 4032, an output shaft of the driving motor 404 is coaxially and fixedly connected with the lead screw 401 for driving the lead screw 401 to rotate. A programmable controller is disposed on the driving motor 404 for driving the driving motor 404 to control a moving distance, a moving speed, and a moving position of the moving base 20.

The transverse folding unit includes a left folding rod 501 and a right folding rod 502, and the left folding rod 501 and the right folding rod 502 respectively fold the left bottom plate and the right bottom plate of each of the square paperboard boxes 902. The vertical folding unit includes an upper folding mechanism and a lower folding mechanism, and the upper folding mechanism and the lower folding mechanism respectively fold the upper bottom plate and the lower bottom plate of each of the square paperboard boxes 902.

Please refer to FIGS. 1, 3, 5, 7, and 11, a secondary plate 304 is horizontally and fixedly connected to one side, distal from the moving base 20, of the adsorbing base 30, both the upper folding mechanism and the lower folding mechanism are disposed above the secondary plate 304, a second slot 305 is defined on one end, close to the adsorbing base 30, of the secondary plate 304, and the second slot 350 vertically penetrates through the secondary plate 304. The lower folding mechanism includes a second overturning plate 503 and a cam 806, the second overturning plate 503 is L-shaped and is rotatably disposed in the second slot 305, rotation shafts are horizontally disposed at horizontal ends of the second overturning plate 503 for rotatably connecting the second overturning plate 503 and the secondary plate 304, a rotation axis of the second overturning plate 503 is parallel to the length direction of the supporting table 10. A torsion spring is disposed on the second overturning plate 503, when the second overturning plate 503 is driven by external torque to overturn, the torsion spring disposed on the second overturning plate 503 forces the second overturning plate 503 to reset to an original position. A concave groove is defined on a side wall, with respect to the second slot 305, of the adsorbing base 30, the cam 806 is disposed in the concave groove, a rotation axis of the cam 806 is vertical, and when the cam 806 rotates, the second overturning plate 503 is pushed upwards by 90 degrees to fold the lower bottom plate of each of the square paperboard boxes 902.

As shown in FIGS. 2-3, the upper bending mechanism includes a vertical plate 5041, a transverse plate 5042, a rotating cylinder 5043, and a third overturning plate 5044. The vertical plate 5041 is vertically disposed in a direction of the length direction of the supporting table 10, a bottom of the vertical plate 5041 is fixedly connected to the ground. The transverse plate 5042 is horizontally disposed at an upper end of the vertical plate 5041, a first end of the transverse plate 5042 is fixedly connected to the vertical plate 5041, a second end of the transverse plate 5042 horizontally extends towards a direction close to the adsorbing base 30, an end surface of the second end of the transverse plate 5042 is parallel to the length direction of the supporting table 10, and the rotating cylinder 5043 is disposed on the end surface of the second end of the transverse plate 5042. The rotating cylinder 5043 is externally connected to air source, A solenoid valve for controlling an operation state of the rotating cylinder 5043 and a controller for controlling action of the solenoid valve are disposed outside the rotating cylinder 5043. An output shaft of the rotating cylinder 5043 is disposed along the length direction of the supporting table 10. The third overturning plate 5044 is a flat-straight plate being horizontally placed. One end of the third overturning plate 5044 is fixedly connected to the output shaft of the rotating cylinder 5043, a press switch is disposed on the second overturning plate 503, and the press switch is electrically connected to the controller controlling the action of the solenoid valve. When the second overturning plate 503 overturns to overturn and fold the lower bottom plate of each of the square paperboard boxes 902, the press switch is pressed and triggered, the controller electrically connected to the press switch controls the solenoid valve to operate, so that the rotating cylinder 5043 drives the third overturning plate 5044 to rotate downwards by 90 degrees to fold the upper bottom plate of each of the square paperboard boxes 902. After the rotating cylinder 5043 drives the third overturning plate 5044 to rotate downwards by 90 degrees, the controller controls the solenoid valve to continue to operate, so that the rotating cylinder 5043 reversely rotates to drive the third overturning plate to reset to an original position.

The transmitting unit includes a first push rod 202, a second push rod 306, a sliding hole 307, a first transmitting group, a second transmitting group, and a third transmitting group. The first push rod 202 and the second push rod 306 are parallel to the guiding rod 402, the sliding hole 307 is defined in the adsorbing base and slidably matched with the second push rod. The first transmitting group, the second transmitting group, and the third transmitting group are all in gear transmission with the second push rod 306.

Figure 5:
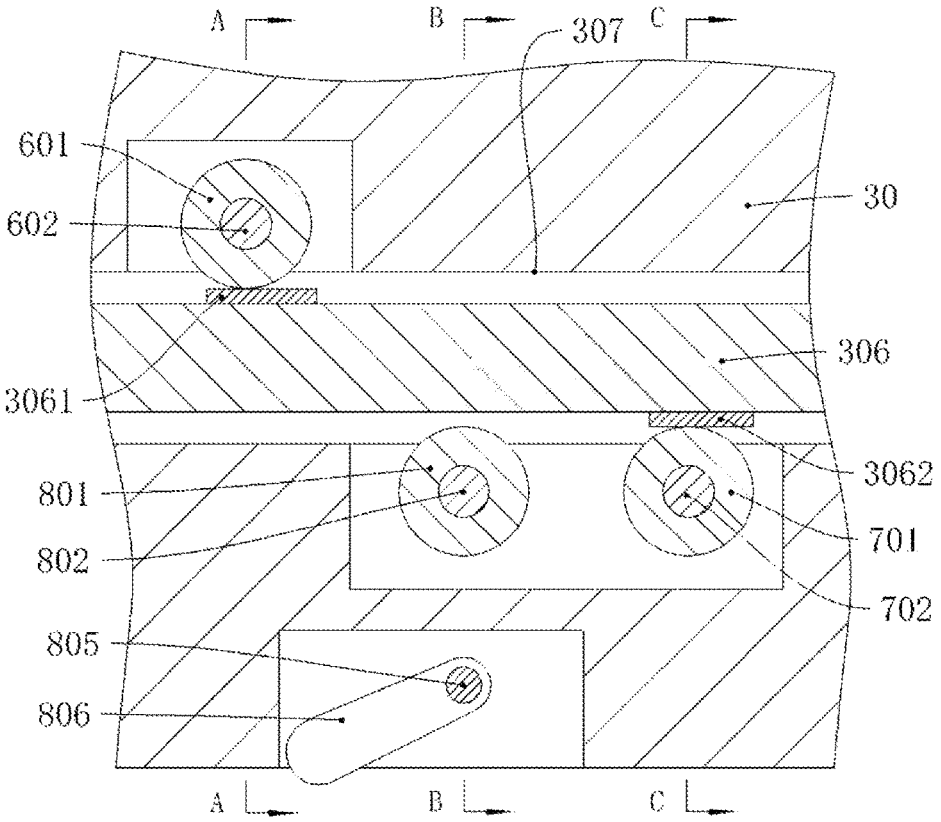
FIG. 5 is a schematic diagram of a partial structure in an adsorbing base in a top view.
Figure 6:
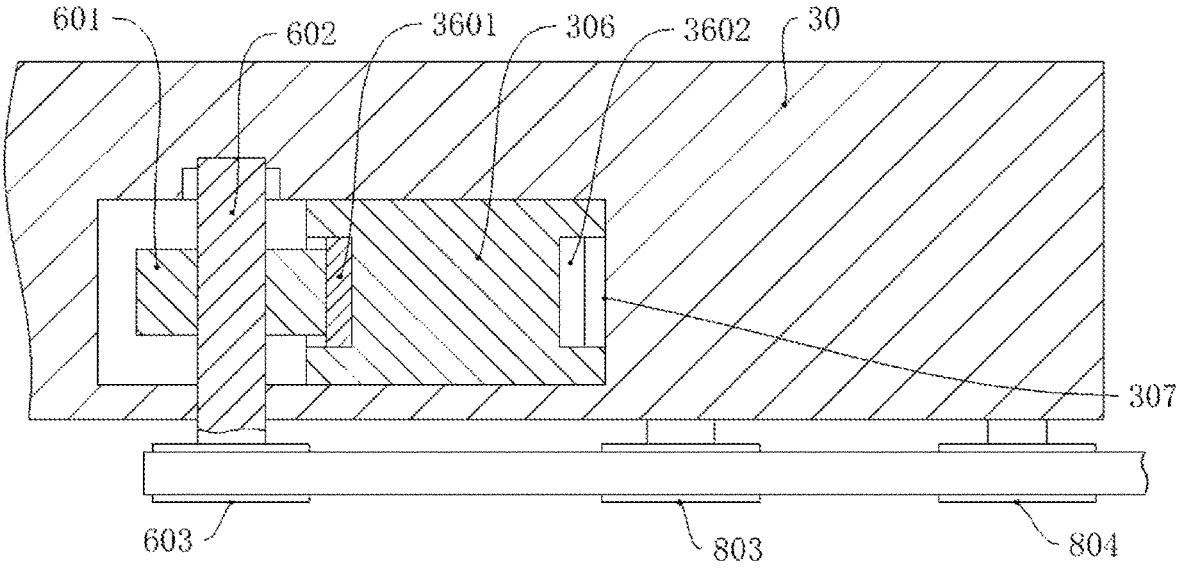
FIG. 6 is a cross-sectional schematic diagram taken along the line A-A shown in FIG. 5.
Figure 7:
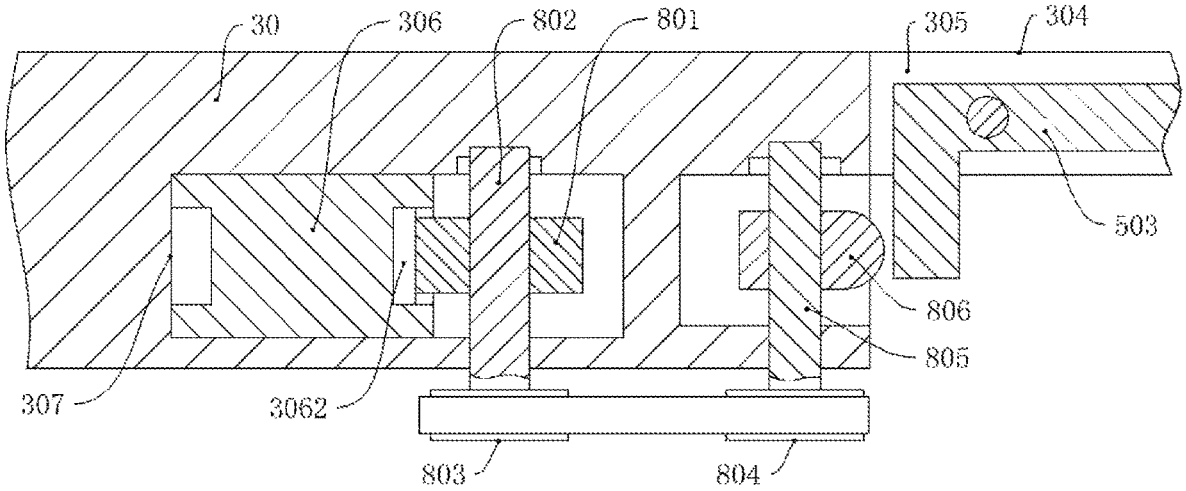
FIG. 7 is a cross-sectional schematic diagram taken along the line B-B shown in FIG. 5 showing a cooperation of a cam and a third overturning plate.
Figure 8:
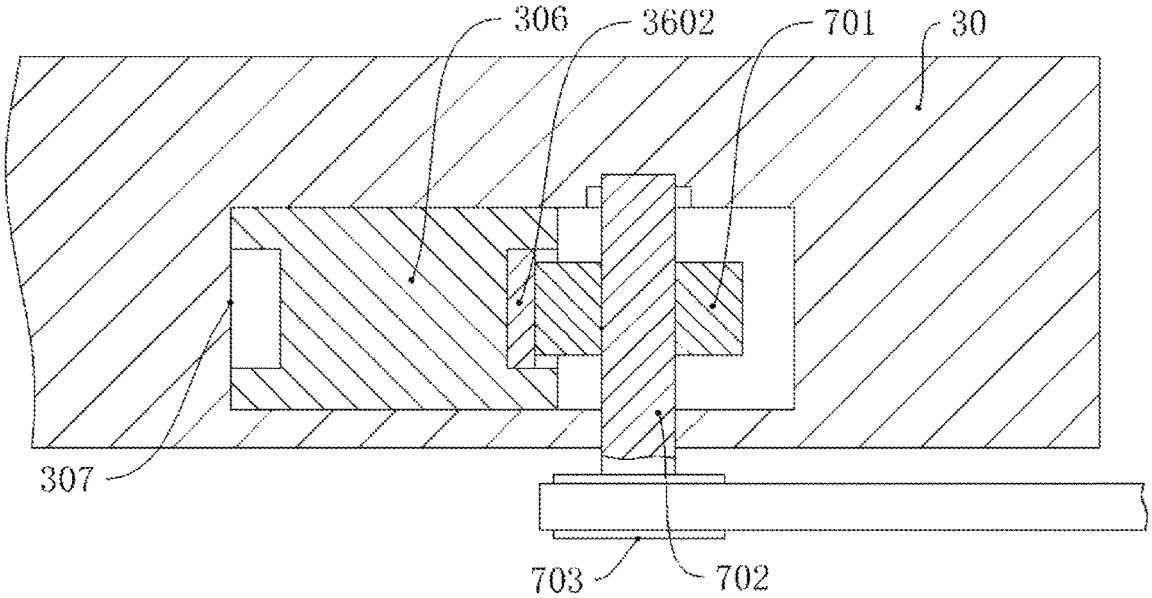
FIG. 8 is a cross-sectional schematic diagram taken along the line C-C shown in FIG. 5.
Figure 9:
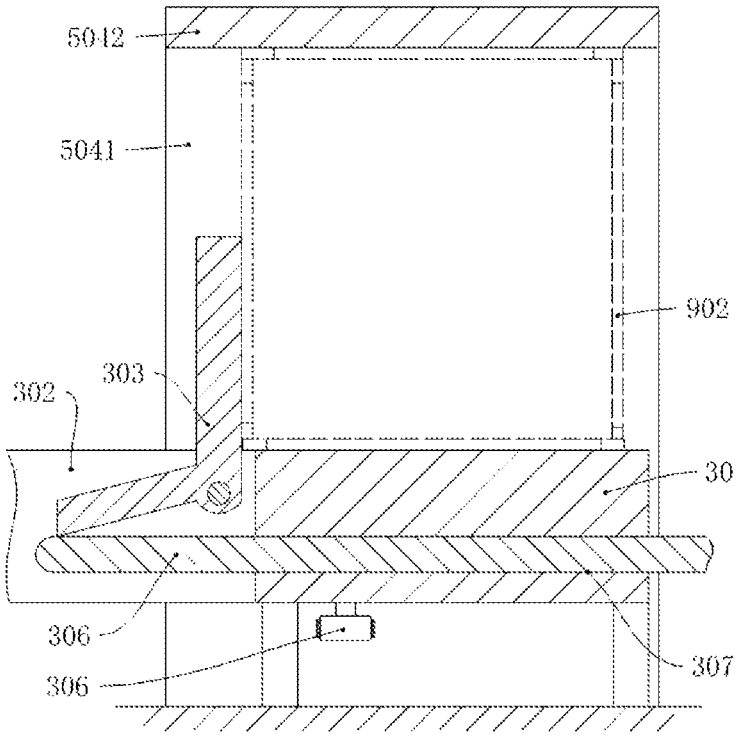
FIG. 9 is a structural schematic diagram of a first overturning plate being pushed by a second push rod to overturn to be in a vertical state.
Figure 12:
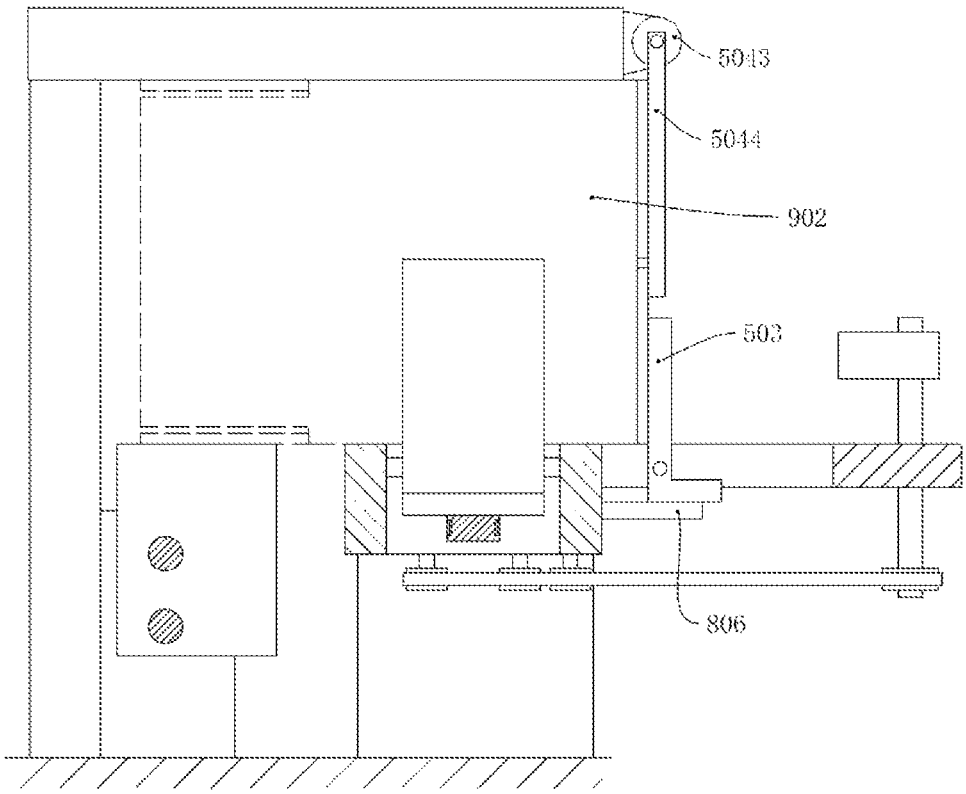
FIG. 12 is a structural schematic diagram of the third overturning plate folding an upper bottom plate of the square paperboard box.

Please refer to FIGS. 1, 3, and 9, a first end of the first push rod 202 is fixedly connected to the moving base 20, a second end of the first push rod 202 is fixedly connected to a connecting plate 204, the sliding hole 307 penetrates through the adsorbing base 30 along a middle portion of the adsorbing base 30. One end, close to the storage rack 101, of the second push rod 306 is a first end of the second push rod 306, the first end of the second push rod 306 is a free end, and a second end of the second push rod 306 is fixedly connected to the connecting plate 204. As shown in FIGS. 2, 9, and 12, when the moving base 20 moves towards a direction close to the storage rack 101, the first push rod 202 drives the second push rod 306 to synchronously move through the connecting plate 204, the first end of the second push rod 306 extends out of the adsorbing base 30 and pushes the first overturning plate 303 to rotate upwards to overturn to overturn the bottommost one of the folded paper boards 901 on the surface of the adsorbing base 30 to be a square paperboard box 902, at this time, an upper surface of the square paperboard box 902 contacts with a lower surface of the transverse plate 5042 to prevent the square paperboard box 902 from continuing to deviate in a direction distal from the first overturning plate 303, so that the square paperboard box 902 is kept in a rectangular state. As shown in FIGS. 5-6, the second push rod 306 is vertical I-shaped steel having grooves on two sides, a first gear rack 3061 is fixedly connected to a first one of the grooves on a first side, close to the moving base 20, of the second push rod 306 along a length direction of the second push rod 306, a second gear rack 3062 is fixedly connected to a second one of the grooves on a second side, close to the secondary plate 304, of the second push rod 306 along the length direction of the second push rod 306. A length of the first gear rack 3061 is the same as a length of the second gear rack 3062, a distance between a first end of the first gear rack 3061 and a first end of the second push rod 306 is less than a distance between a first end of the second gear rack 3062 and the first end of the second push rod 306. The first transmitting group is meshed with the first gear rack 3061 for driving the left folding rod 501 to rotate, the second transmitting group and the third transmitting group are both meshed with the second gear rack 302 for respectively driving the right folding rod 502 and the cam 806 to rotate.

As shown in FIGS. 1-3 and 5-6, the first transmitting group includes a first rotating shaft 602, a first gear 602, a first driving wheel 603, a first driven wheel 604, and a first rotating rod 605. The first rotating shaft 602 is vertically disposed in the adsorbing base 30 and rotatably connected to the adsorbing base 30, the first gear 601 is coaxially and unidirectionally rotatably connected to the first rotating shaft 602 and meshed with the first gear rack 3061, the first driving wheel 603 is coaxially and fixedly connected to the first rotating shaft 602, the first driven wheel 604 is in belt transmission with the first driving wheel 603, and the first rotating rod 605 is rotatably connected to the secondary plate 304. The first driven wheel 604 is coaxially and fixedly connected to the first rotating rod 605, and the left folding rod 501 is coaxially and fixedly connected to the first rotating rod 605. Specifically, the first rotating shaft 602 is vertically disposed on the first side, close to the moving base 20, of the second push rod 306, a thrust bearing is disposed on an upper end of the first rotating shaft 602 for rotatably connecting the first rotating shaft 602 with the adsorbing base 30, a reset torsion spring is sleeved on the first rotating shaft 602, a first end of the reset torsion spring is fixedly connected to the first rotating shaft 602, and a second end of the reset torsion spring is fixedly connected to the adsorbing base 30. When torque acts on the first rotating shaft 602 to rotate the first rotating shaft 602 to deform the reset torsion spring, the reset torsion spring disposed on the first rotating shaft 602 forces the first rotating shaft 602 to reset, a cavity for rotation of the first gear 601 is defined in the adsorbing base 30, the first gear 601 is disposed in the cavity and meshed with the first gear rack 3061. A unidirectional bearing is disposed between the first gear 601 and the first rotating shaft 602 for unidirectionally and rotatably connecting the first gear 601 with the first rotating shaft 602. A lower end of the first rotating shaft 602 extends downwards to be out of the adsorbing base 30, the first driving wheel 603 is disposed at the lower end of the first rotating shaft 602, the first rotating shaft 605 is rotatably connected to the secondary plate 304. The first rotating rod 605 is vertically disposed, an upper end of the first rotating rod 605 is located above the secondary plate 304, a lower end of the first rotating rod 605 is located below the secondary plate 304, the left folding rod 501 is fixedly connected to the upper end of the first rotating rod 605, and the first driven wheel 604 is fixedly connected to the lower end of the first rotating rod 605.

As shown in FIGS. 1-3, 5, and 8, the second transmitting group includes a second rotating shaft 702, a second gear 701, a second driving wheel 703, a second driven wheel 704, and a second rotating rod 705. The second rotating shaft 702 is vertically disposed in the adsorbing base 30 and rotatably connected to the adsorbing base 702, the second gear 701 is coaxially and unidirectionally rotatably connected to the second rotating shaft 702 and meshed with the second gear rack 701, the second driving wheel 703 is coaxially and fixedly connected to the second rotating shaft 702, the second driven wheel 704 is in belt transmission with the second driving wheel 703, and the second rotating rod 705 is rotatably connected to the secondary plate 304. The second driven wheel 704 is coaxially and fixedly connected to the second rotating rod 705, and the right folding rod 502 is coaxially and fixedly connected to the second rotating rod 705. Specifically, the second rotating shaft 702 is vertically disposed on the second side, close to the secondary plate 304, of the second push rod 306, a thrust bearing is disposed on an upper end of the second rotating shaft 702 for rotatably connecting the second rotating shaft 702 with the adsorbing base 30, a reset torsion spring is sleeved on the second rotating shaft 702, a first end of the reset torsion spring is fixedly connected to the second rotating shaft 702, and a second end of the reset torsion spring is fixedly connected to the adsorbing base 30. When torque acts on the second rotating shaft 702 to rotate the second rotating shaft 702 to deform the reset torsion spring, the reset torsion spring disposed on the second rotating shaft 702 forces the second rotating shaft 702 to reset, a cavity for rotation of the second gear 701 is defined in the adsorbing base 30, the second gear 701 is disposed in the cavity and meshed with the second gear rack 3062. A unidirectional bearing is disposed between the second gear 701 and the second rotating shaft 702 for unidirectionally and rotatably connecting the second gear 701 with the second rotating shaft 702. A lower end of the second rotating shaft 702 extends downwards to be out of the adsorbing base 30, the second driving wheel 703 is disposed at the lower end of the second rotating shaft 702, the second rotating shaft 705 is rotatably connected to the secondary plate 304. The second rotating rod 705 is vertically disposed, an upper end of the second rotating rod 705 is located above the secondary plate 304, a lower end of the second rotating rod 705 is located below the secondary plate 304, the right folding rod 502 is fixedly connected to the upper end of the second rotating rod 705, and the second driven wheel 704 is fixedly connected to the lower end of the second rotating rod 705.

As shown in FIGS. 1-3, 5, and 7, the third transmitting group includes a third rotating shaft 802, a third gear 801, a third driving wheel 803, a third driven wheel 804, and a third rotating rod 805. The third rotating shaft 802 is vertically disposed in the adsorbing base 30 and rotatably connected to the adsorbing base 30, the third gear 802 is coaxially and unidirectionally rotatably connected to the third rotating shaft 801 and meshed with the second gear rack 3062, the third driving wheel 803 is coaxially and fixedly connected to the third rotating shaft 802, the third driven wheel 804 is in belt transmission with the third driving wheel 803, and the third rotating rod 805 is rotatably connected to the adsorbing base 30. The third driven wheel 804 is coaxially and fixedly connected the third rotating rod 805, and the cam 806 is coaxially and fixedly connected to the third rotating rod 805. Specifically, the third rotating shaft 802 is vertically disposed on the second side, close to the secondary plate 304, of the second push rod 306, a thrust bearing is disposed on an upper end of the third rotating shaft 802 for rotatably connecting the third rotating shaft 802 with the adsorbing base 30, a reset torsion spring is sleeved on the third rotating shaft 802, a first end of the reset torsion spring is fixedly connected to the third rotating shaft 802, and a second end of the reset torsion spring is fixedly connected to the adsorbing base 30. When torque acts on the third rotating shaft 802 to rotate the third rotating shaft 802 to deform the reset torsion spring, the reset torsion spring disposed on the third rotating shaft 802 forces the third rotating shaft 802 to reset, a cavity for rotation of the third gear 801 is defined in the adsorbing base 30, the third gear 801 is disposed in the cavity and meshed with a third gear rack, in a direction parallel to the length direction of the second push rod 306, the third gear 801 is located between the first gear 601 and the second gear 701, and a distance between the third gear 801 and the second gear 701 is larger than a length of the second gear rack 3062. A unidirectional bearing is disposed between the third gear 801 and the third rotating shaft 802 for unidirectionally and rotatably connecting the third gear 801 with the third rotating shaft 802. An upper end of the third rotating rod 805 penetrates upwards though the concave groove where the cam 806 is disposed in and is rotatably connected to the adsorbing base 30, a lower end of the third rotating shaft 805 extends downwards to be out of the adsorbing base 30, the cam 806 is fixedly connected to the upper end of the third rotating rod 805, and the third driven wheel 804 is fixedly connected to the lower end of the third rotating rod 805.

In the embodiment, the first driving wheel 603 is in V-ribbed belt transmission with the first driven wheel 604, the second driving wheel 703 is in V-ribbed belt transmission with the second driven wheel 704, and the third driving wheel 803 is in V-ribbed belt transmission with the third driven wheel 804. In other embodiments, the first driving wheel 603 may be in V-belt or round-belt transmission with the first driven wheel 604, the second driving wheel 703 may be in V-belt or round-belt transmission with the second driven wheel 704, and the third driving wheel 803 may be in V-belt or round-belt transmission with the third driven wheel 804.

In actual use of the present disclosure, the folded paper boards 901 preliminarily formed after printing, pressing, die cutting, and nailing at ends are stacked and placed in the storage rack 101, the bottommost one of the folded paper boards 901 in the storage rack 101 falls on the supporting table 10, the moving base 20 is controlled to locate below one end of the bottommost one of the folded paper boards 901, a first suction cup contacts a lower surface of the bottommost one of the folded paper boards 90, after the sensor detects that the moving base 20 moves to a designated position and contacts the bottommost one of the folded paper boards 901, the microcomputer controls the vacuumizing device to operate to adsorb the bottommost one of the folded paper boards 901 on the first vacuum suction cup 201. After the driving motor 404 is controlled to drive the moving base 20 to transport the folded paper boards 901 to a designated position on the second vacuum suction cup 301 on the adsorbing base 20, the first vacuum suction cup 201 releases the folded paper boards 901, and the second vacuum suction cup 301 adsorbs the folded paper boards 901.

In a process that the moving base 20 moves from the adsorbing base 30 to a position close to the storage rack 101, the first push rod 202 fixedly connected to the moving base 20 drives the second push rod 306 to slide in the sliding hole 307, so that the first end of the second push rod 306 extends out of the adsorbing base 30 to push the first overturning plate 303. As shown in FIGS. 2 and 9, the first overturning plate 303 is pushed by the second push rod 306 to overturn, so that the folded paper boards 901 on the adsorbing base 30 are overturned to form the square paperboard boxes 902.

Figure 10:
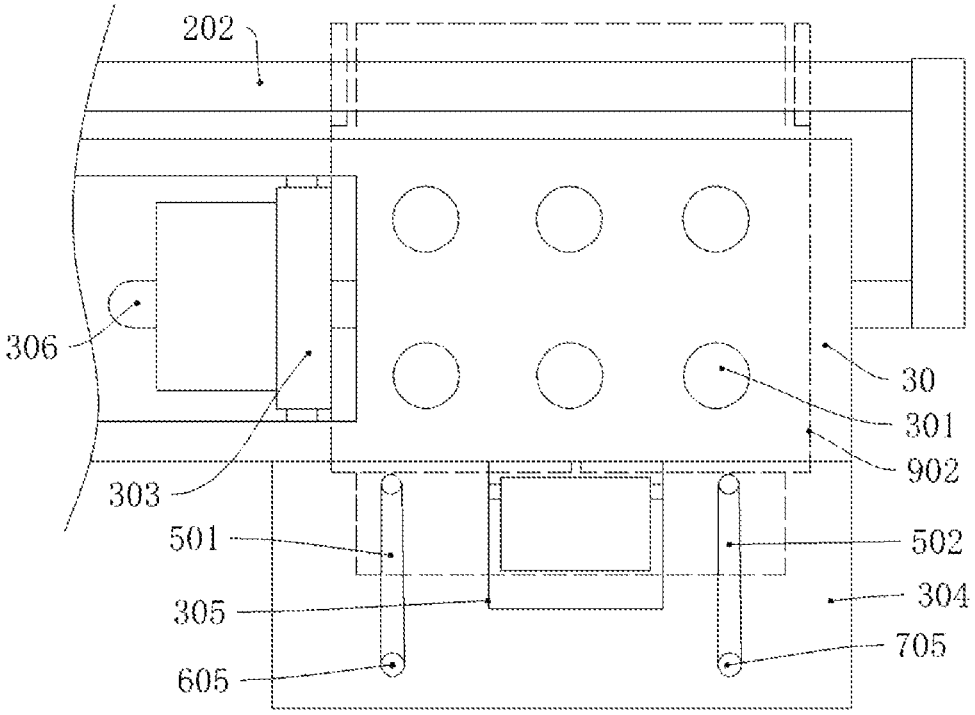
FIG. 10 is a structural schematic diagram of a left folding rod and a right folding rod respectively folding a left bottom plate and a right bottom plate of a square paperboard box.
Figure 11:
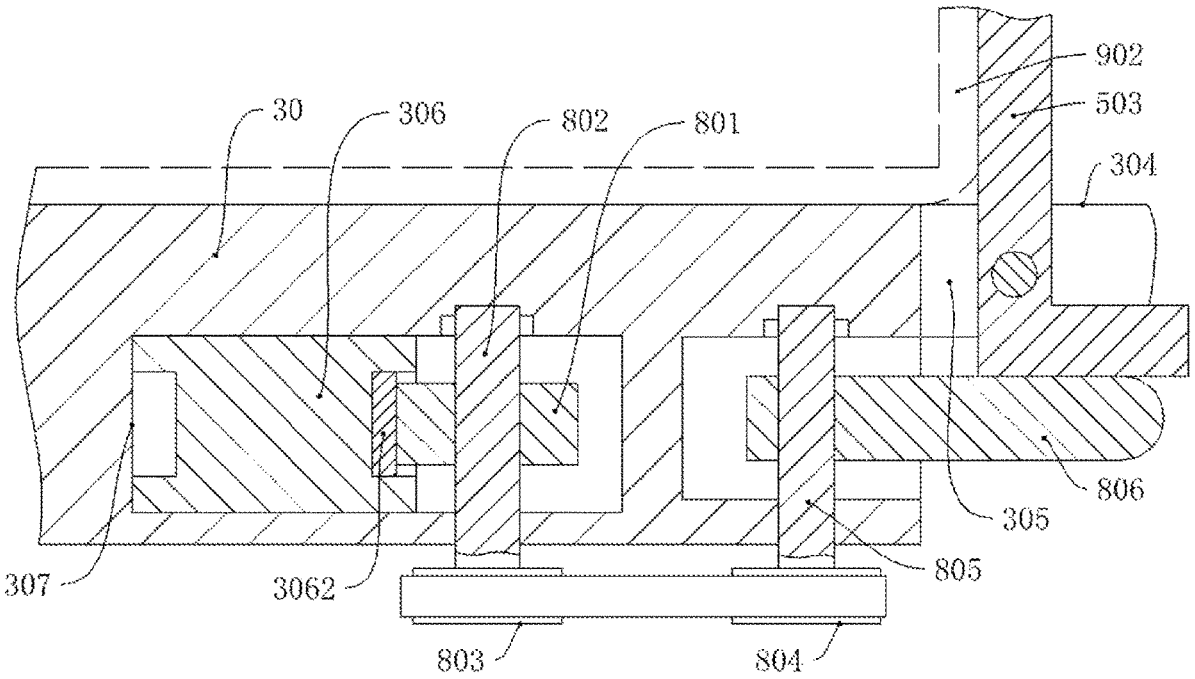
FIG. 11 is a structural schematic diagram of a second overturning plate folding a lower bottom plate of the square paperboard box.

In a process that the moving base 20 continues to move towards the position close to the storage rack 101, the first gear rack 3061 and the second gear rack 3062 on the second push rod 306 are respectively and synchronously meshed with the first gear 601 and the second gear 701. The first gear 601 and the first rotating shaft 602 synchronously rotate, the second gear 701 and the second rotating shaft 702 synchronously rotate, at this time, the reset torsion springs on the first rotating shaft 602 and the second rotating shaft 702 are compressed. Please refer to FIG. 10, the first gear 601 and the second gear 701 rotate to drive the left folding rod 501 and the right folding rod 502 on the secondary plate 304 to rotate to fold the left bottom plate and the right bottom plate of each the square paperboard boxes.

After the second push rod 306 moves to enable the first gear rack 3061 and the second gear rack 3062 to respectively cross the first gear 601 and the second gear 701, the first gear 601 and the second gear 701 are respectively separated from the first gear rack 3061 and the second gear rack 3062 and are not subjected to external torque, the first rotating shaft 602 and the second rotating shaft 702 both rotates to reset to original positions under elastic force of the reset torsion spring of the first rotating shaft 602 and elastic force of the reset torsion spring of the second rotating shaft 702, so that the left folding rod 501 and the right folding rod 502 are reset to leave each of the square paperboard boxes 902.

As the second push rod 306 continues to move, after the second gear rack 3062 completely crosses the second gear 701, the second gear rack 3062 is directly meshed with the third gear 801, so that the third gear 801 finally drives the cam 806 to rotate to overturn the third overturning plate 5044. The third overturning plate 5044 overturns upwards by 90 degrees to overturn the upper bottom plate of each of the square paperboard boxes 902 to overturn upwards by 90 degrees. The reset torsion spring on the third rotating shaft 802 is compressed, after the second gear rack 3062 crosses the third gear 801, the reset torsion spring on the third rotating shaft 802 resets the cam 806, and the torsion spring on the second overturning plate 503 resets the second overturning plate 503.

When the second overturning plate 503 folds the lower bottom plate of each of the square paperboard boxes 902, the press switch on the second overturning plate 503 is pressed to trigger, so that the rotating cylinder 5043 drives the third overturning plate 5044 to rotate downwards by 90 degrees to fold the upper bottom plate of each of the square paperboard boxes 902 and then turn back to the original position, so that bottom plates at one end of each of square paperboard boxes 902 is completely folded to form a formed carton.

After the moving base 20 moves to a designated position at the storage rack 101 to adsorb the folded paper boards 901, the moving base 20 moves towards a direction close to the adsorbing base 30 to transport the folded paper boards 901. When the second push rod 306 and the moving base 20 synchronously move in a direction distal from the storage rack 10, the first gear rack 3061 reversely contacts the first gear 601, at this time, the first gear 601 unidirectionally rotates and does not synchronously rotate with the first rotating shaft 602, and the first rotating shaft 602 does not rotate under action of the reset torsion spring. Similarly, when the second gear rack 3062 reversely contacts the third gear 801 and the second gear 701, both the third gear 801 and the second gear 701 unidirectionally rotate and do not synchronously rotate with the third rotating shaft 802 and the second rotating shaft 702, and the third rotating shaft 802 and the second rotating shaft 702 do not rotate under actions of the reset torsion springs. When the first end of the second push rod 306 is separated from the first overturning plate 303, the first overturning plate 303 rotates to reset under the action of the reset torsion spring on the first overturning plate 303. When the moving base 20 is close to the adsorbing base 30, the sensor and the microcomputer control the external vacuumizing device to stop vacuumizing the second vacuum suction cup 301, and the first push plate 203 on the moving base 20 pushes the formed carton away from the adsorbing base 30, so that continuous carton folding and forming operation are repeatedly performed.

Compared with cartons formed by the manual operation, the automatic carton forming device of the present disclosure is high in forming speed and less in manual intervention, which reduces labor intensity of workers, reduces labor cost, and further improves carton forming efficiency.

The foregoing is merely embodiments of the present disclosure, and common general knowledge such as well-known specific structures and features is not described herein. It should be noted that, for a person skilled in the art, several variations and improvements may be made without departing from the structure of the present disclosure, and these should also be regarded as the scope of protection of the present disclosure, which does not affect the effect and practicability of the embodiments of the present disclosure. The scope of protection claimed in the present disclosure shall be subject to the content of its claims, the specification of the specific implementation and other records shall be used to interpret the content of the claims.

What is claimed is:

1. An automatic carton forming device, comprising:

a supporting table;

a storage rack;

a limiting part;

a transporting part; and a folding part;

wherein the storage rack is configured to store folded paper boards, the limiting part is configured to limit the folded paper boards, the transporting part is configured to transport the folded paper boards in the storage rack to the limiting part, and the folding part is configured to unfold the folded paper boards on the limiting part;

the storage rack is vertically disposed on the supporting table, the folded paper boards are vertically stacked in the storage rack for completely extending a bottommost one of the folded paper boards out of the storage rack to directly contact an upper surface of the supporting table;

the transporting part comprises a moving base and a driving unit, the driving unit drives the moving base to move in a length direction of the supporting table, at least one first vacuum suction cup is disposed on the moving base for adsorbing the folded paper boards;

the limiting part comprises an adsorbing base, the adsorbing base is disposed at one end of the supporting table, at least one second vacuum suction cup is disposed on the adsorbing base for adsorbing the folded paper boards and fixing the folded paper boards on the adsorbing base;

the folding part comprises a first overturning plate, a vertical folding unit, a transverse folding unit, and a transmitting unit; the first overturning plate is rotatably connected to the adsorbing base for overturning the folded paper boards to preliminarily unfold the folded paper boards to form square paperboard boxes, the vertical folding unit symmetrically folds an upper bottom plate and a lower bottom plate of each of the square paperboard boxes, the transverse folding unit symmetrically folds a left bottom plate and a right bottom plate of each of the square paperboard boxes, and the transmitting unit drives the first overturning plate, the vertical folding unit, and the transverse folding unit to perform folding action according to movement of the moving base.

2. The automatic carton forming device according to claim 1, wherein a width of the supporting table is smaller than a width of each of the folded paper boards, so that a part of a board body of each of the folded paper boards is positioned out of one side, close to the moving base, of the supporting table.

3. The automatic carton forming device according to claim 2, wherein an upper surface of the adsorbing base is flush with the upper surface of the supporting table, a first slot is vertically disposed on the adsorbing base for overturning of the first overturning plate, the first overturning plate is an L-shaped overturning plate, and a rotation axis of the first overturning plate is horizontally disposed and is perpendicular to the length direction of the supporting table.

4. The automatic carton forming device according to claim 3, wherein the driving unit comprises a lead screw, a guiding rod, supporting plates, and a driving motor; the lead screw is disposed in parallel with the length direction of the supporting table, the guiding rod is disposed in parallel with the lead screw, the supporting plates are respectively disposed on two ends of the lead screw and two end of the guiding rod, and the driving motor is fixedly connected with one of the supporting plates for driving the lead screw to rotate; a threaded through hole matched with the lead screw and a guiding hole slidably matched with the guiding rod are defined on the moving base.

5. The automatic carton forming device according to claim 4, wherein the transverse folding unit comprises a left folding rod and a right folding rod, and the left folding rod and the right folding rod respectively fold the left bottom plate and the right bottom plate of each of the square paperboard boxes; the vertical folding unit comprises an upper folding mechanism and a lower folding mechanism, and the upper folding mechanism and the lower folding mechanism respectively fold the upper bottom plate and the lower bottom plate of each of the square paperboard boxes.

6. The automatic carton forming device according to claim 5, wherein a secondary plate is horizontally and fixedly connected to the adsorbing base, the left folding rod and the right folding rod are rotatably disposed on the secondary plate, a second slot is defined on the secondary plate for rotation of the lower folding mechanism; the lower folding mechanism comprises a second overturning plate and a cam, the second overturning plate is L-shaped and is rotatably disposed at the second slot of the secondary plate, and the cam is rotated to push the second overturning plate to overturn; a rotation axis of the second overturning plate is parallel to the length direction of the supporting table;

the upper folding mechanism comprises a vertical plate, a transverse plate, and a rotating cylinder; the transverse plate is disposed at an upper end of the vertical plate, the rotating cylinder is disposed on an end surface of the transverse plate for folding the upper bottom plate of each of the square paperboard boxes; a third overturning plate is fixedly connected to an output shaft of the rotating cylinder, and the third overturning plate is flat-shaped.

7. The automatic carton forming device according to claim 6, wherein the transmitting unit comprises a first push rod, a second push rod, a sliding hole, a first transmitting group, a second transmitting group, and a third transmitting group; the first push rod and the second push rod are parallel to the guiding rod, the sliding hole is defined in the adsorbing base and slidably matched with the second push rod; the first transmitting group, the second transmitting group, and the third transmitting group are all in gear transmission with the second push rod;

a first end of the first push rod is fixedly connected to the moving base, a second end of the first push rod is fixedly connected to a connecting plate, the sliding hole penetrates through the adsorbing base, a first end of the second push rod is a free end, and a second end of the second push rod is fixedly connected to the connecting plate; a first side of the second push rod is fixedly connected to a first gear rack, a second side of the second push rod is fixedly connected to a second gear rack, the first transmitting group is meshed with the first gear rack for driving the left folding rod to rotate, the second transmitting group and the third transmitting group are both meshed with the second gear rack for respectively driving the right folding rod and the cam to rotate.

8. The automatic carton forming device according to claim 7, wherein the first transmitting group comprises a first rotating shaft, a first gear, a first driving wheel, a first driven wheel, and a first rotating rod; the first rotating shaft is vertically disposed in the adsorbing base and rotatably connected to the adsorbing base, the first gear is coaxially and unidirectionally rotatably connected to the first rotating shaft and meshed with the first gear rack, the first driving wheel is coaxially and fixedly connected to the first rotating shaft, the first driven wheel is in belt transmission with the first driving wheel, and the first rotating rod is rotatably connected to the secondary plate; the first driven wheel is coaxially and fixedly connected to the first rotating rod, and the left folding rod is coaxially and fixedly connected to the first rotating rod;

the second transmitting group comprises a second rotating shaft, a second gear, a second driving wheel, a second driven wheel, and a second rotating rod; the second rotating shaft is vertically disposed in the adsorbing base and rotatably connected to the adsorbing base, the second gear is coaxially and unidirectionally rotatably connected to the second rotating shaft and meshed with the second gear rack, the second driving wheel is coaxially and fixedly connected to the second rotating shaft, the second driven wheel is in belt transmission with the second driving wheel, and the second rotating rod is rotatably connected to the secondary plate; the second driven wheel is coaxially and fixedly connected to the second rotating rod, and the right folding rod is coaxially and fixedly connected to the second rotating rod; and the third transmitting group comprises a third rotating shaft, a third gear, a third driving wheel, a third driven wheel, and a third rotating rod; the third rotating shaft is vertically disposed in the adsorbing base and rotatably connected to the adsorbing base, the third gear is coaxially and unidirectionally rotatably connected to the third rotating shaft and meshed with the second gear rack, the third driving wheel is coaxially and fixedly connected to the third rotating shaft, the third driven wheel is in belt transmission with the third driving wheel, and the third rotating rod is rotatably connected to the adsorbing base; the third driven wheel is coaxially and fixedly connected the third rotating rod, and the cam is coaxially and fixedly connected to the third rotating rod.

9. The automatic carton forming device according to claim 8, wherein reset torsion springs are respectively disposed between the first rotating shaft and the adsorbing base, between the second rotating shaft and the adsorbing base, and between the third rotating shaft and the adsorbing base; when the first rotating shaft, the second rotating shaft, and the third rotating shaft are not subjected to other torque, elastic force of the reset torsion springs drive the first rotating shaft, the second rotating shaft, and the third rotating shaft to reset to original positions.

10. The automatic carton forming device according to claim 9, wherein the second push rod is I-shaped steel having grooves on two sides, and the first gear rack and the second gear rack are respectively disposed in the grooves on the two sides of the second push rod.

* * * * *